US005131719A

United States Patent [19]

Kassai

[11] Patent Number: 5,131,719

[45] Date of Patent: Jul. 21, 1992

[54] HEIGHT-CONTROLLABLE CHAIR WITH WHEEL LOCK MECHANISM AND ADJUSTABLE TRAY

[75] Inventor: Kenzou Kassai, Osaka, Japan

[73] Assignee: Aprica Kassai Kabushikikaisha, Osaka, Japan

[21] Appl. No.: 727,277

[22] Filed: Jul. 11, 1991

[30] Foreign Application Priority Data

Jul. 11, 1990 [JP] Japan ..... 2-74265[U]
Jul. 12, 1990 [JP] Japan ..... 2-74983[U]
Jul. 17, 1990 [JP] Japan ..... 2-76808[U]

[51] Int. Cl.[5] ..... A47D 1/00; A47C 1/00

[52] U.S. Cl. ..... 297/345; 297/151; 297/26; 280/649

[58] Field of Search ..... 297/345, 347, 16, 19, 297/24–28, 47, 48, 148–151, 153; 280/647–650, 642, 643, 47.38, 47.4, 47.41

[56] References Cited

U.S. PATENT DOCUMENTS

| | | | |
|---|---|---|---|
| 968,297 | 8/1910 | Washburn | 297/345 |
| 2,902,084 | 9/1959 | Stevens | 297/149 |
| 4,251,107 | 2/1981 | Sato | 297/19 |
| 4,359,242 | 11/1982 | Gerken et al. | 280/649 X |
| 4,567,964 | 2/1986 | Kassai | 280/642 X |

*Primary Examiner*—Kenneth J. Dorner
*Assistant Examiner*—James M. Gardner
*Attorney, Agent, or Firm*—W. G. Fasse

[57] ABSTRACT

Disclosed herein is a height-controllable childcare chair (1). This chair first comprises a pair of side walls (6) which are located on both sides of a seat portion (2). A pair of horizontally extending side bars (8), which are parallel to each other, are fixed to the respective side walls (6). A pair of first leg members (11) are rotatably mounted on the respective side walls (6). A pair of sliders (14) are mounted on the respective side bars (8) to be slidable along the side bars (8). A pair of second leg members (29) are rotatably mounted on the respective sliders (14). Respective intermediate portions of the second leg members (29) are rotatably coupled to respective intermediate portions of the first leg members (11). Wheels (13, 31) are mounted on respective lower end portions of the leg members (11, 29). A plurality of engaging holes (**9*a*–9*h*) are longitudinally distributed along each side bar (8). Each slider (14) comprises a rotatable control lever (3) which is provided on its one end with an engaging projection (26) for engaging with a selected one of the plurality of engaging holes (9*a*–9*h*). This control lever (3) is urged by a spring (27) to be rotated in a direction for allowing engagement of the engaging projection (26) with the selected one of the engaging holes (9*a*–9*h***).

12 Claims, 13 Drawing Sheets

HEIGHT-CONTROLLABLE CHAIR WITH WHEEL LOCK MECHANISM AND ADJUSTABLE TRAY

BACKGROUND OF THE INVENTION

1. Field of the Invention

The present invention relates to a chair having a height-controllable seat portion, and more particularly, it relates to a structure which is applicable to a childcare chair for a baby.

2. Description of the Background Art

A general childcare chair has a seat portion, which is located in a relatively low position, and a reclinable backrest which is provided on the seat portion. Due to the reclinable structure of the backrest, the seat portion can also serve as a bed. Thus, such a childcare chair is also suitable for a baby who cannot yet sit up.

An average Japanese mode of life has increasingly been westernized in recent years. Thus, a baby carer frequently sits on a chair. If the baby is laid on the aforementioned type of a chair having a low seat portion while the baby carer sits on a chair or works in standing, it is difficult to attain communication which is important for childcare since the baby carer cannot face close to the baby.

However, it is rather inadvisable to simply raise the seat portion of the childcare chair for solving the above problem. In order to use the childcare chair in a Japanese-style room, or to keep a sleeping baby in safety, for example, the seat portion is preferably set at the lowest possible position.

SUMMARY OF THE INVENTION

Accordingly, an object of the present invention is to provide a chair, which is rendered height-controllable in order to satisfy the aforementioned requirements.

The chair according to the present invention comprises a pair of side walls, which are positioned on both sides of a seat portion. A pair of horizontally extending side bars, which are parallel to each other, are fixed to the side walls respectively. A pair of first leg members are rotatably mounted on the side walls respectively. A pair of sliders are respectively mounted on the side bars, to be slidable along the side bars. A pair of second leg members are rotatably mounted on the sliders respectively. The intermediate portions of the second leg members are rotatably coupled to the intermediate portions of the first leg members respectively.

A plurality of engaging holes are longitudinally distributed along each side bar. Each slider has a rotatable control lever, which is provided on one end of the lever with an engaging projection for engaging with a selected one of the plurality of engaging holes. This control lever is urged by a spring to be rotated in a direction for bringing the engaging portion into engagement with the selected one of the engaging holes.

The control lever may pass through the side wall. Therefore, the side wall is provided with a through hole extending in a range for allowing such passage as well as rotation of the control lever. In this case, a locking member is preferably operably mounted on the control lever, for example, in order to selectively inhibit rotation of the control lever by filling up a clearance in relation to the control lever within the through hole.

In the aforementioned chair, the sliders slide along the side bars, to change the angle of intersection between the first and second leg members. Thus, the vertical positions of the pair of side bars are changed to change the height of the seat portion. The engaging projections, which are provided in the control levers mounted on the sliders, engage with selected ones of the engaging holes provided in the side bars, to fix the seat portion at the height changed in response to the sliding movement of the sliders. When the control levers are so rotated that the engaging projections disengage from the engaging holes, on the other hand, the sliders can slide along the respective side bars, as described above.

Thus, according to the present invention, it is possible to obtain a chair having a height-controllable seat portion.

While such a chair structure is also applicable to a chair for an adult, the same is further advantageously applied to a chair for a baby, in particular.

When the present invention is applied to a childcare chair, it is possible to attain intimate communication, which is important for childcare, between the baby carer and the baby by controlling the height of the seat portion in response to the position of the baby carer.

When the height of the seat portion is raised, the baby carer can easily nurse the baby or change the diaper in a sitting state on a chair or a standing state. When the seat portion is maintained in such a high position, further, the baby is kept away from the floor and protected against dust or the like in sanitation.

In order to use the chair in a Japanese-style room or to keep a sleeping baby in safety, on the other hand, it is possible to bring the seat portion into a low position.

According to the present invention, the engaging projections which are provided on the control levers are adapted to engage with selected ones of the engaging holes which are provided on the side bars, in order to fix the sliders at a plurality of positions on the side bars. Further, the control levers are urged by the springs to be rotated in directions for bringing the engaging projections into engagement with the engaging holes. Therefore, the engaging projections can automatically engage with the engaging holes, whereby the height-control operation is simplified and the seat portion can be strictly maintained at the controlled height. Thus, it is possible to implement excellent safety.

When the control levers are so provided as to pass through the side walls and the side walls are provided with through holes extending in a range for allowing such passage as well as rotation of the control levers while the locking members are adapted to selectively inhibit rotation of the control levers by filling up clearances in relation to the control levers within the through holes, the locking members prevent the control levers from unexpected rotation. Thus, it is possible to obtain a chair which is further excellent in safety. When the locking members are thus adapted to prevent the control levers from unexpected rotation, the control levers can be prevented from accidental rotation caused by contact with foreign matters even if manually operated portions of the control levers are increased in size or extremely projecting from the side walls Therefore, it is possible to provide the manually operated portions of the control levers in a handy mode with no problem.

Preferably, the inventive chair further comprises rotatable wheels which are mounted on lower end portions of the leg members. These wheels facilitate movement of the chair to an arbitrary position while prompting movement of the leg portions with respect to the floor, whereby the height of the seat portion can be easily controlled. The present invention also provides a wheel stopper for selectively bringing such wheels into a stopped state.

The inventive chair may further comprise a table which is mounted to extend across the aforementioned pair of side walls. Preferably, the position of this table is horizontally adjustable.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The accompanying drawings are adapted to illustrate a childcare chair 1 according to an embodiment of the present invention.

Figure 1:
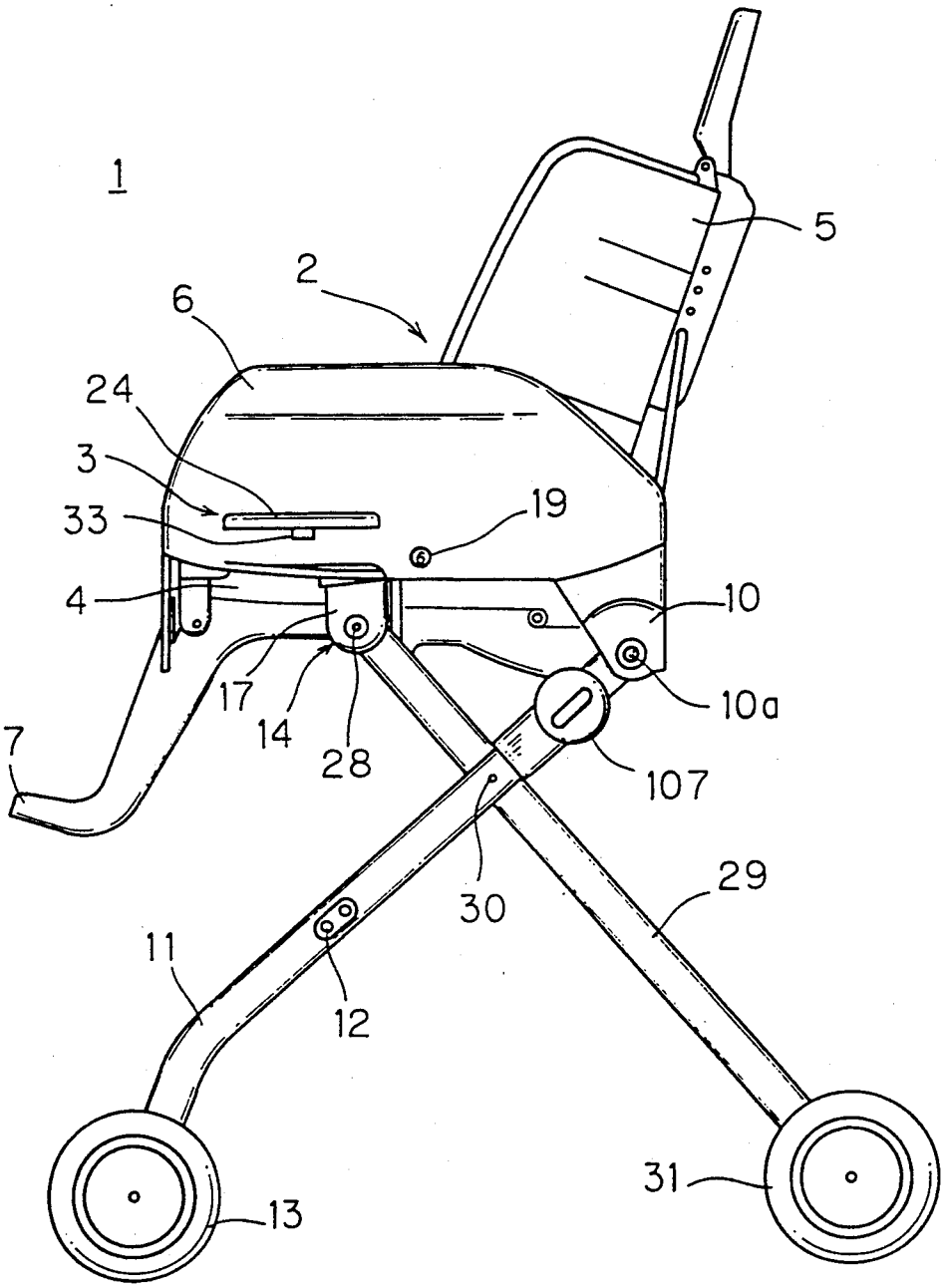
FIG. 1 is a side elevational view showing a childcare chair 1 according to an embodiment of the present invention, whose seat portion 2 is brought into the uppermost position.
Figure 2:
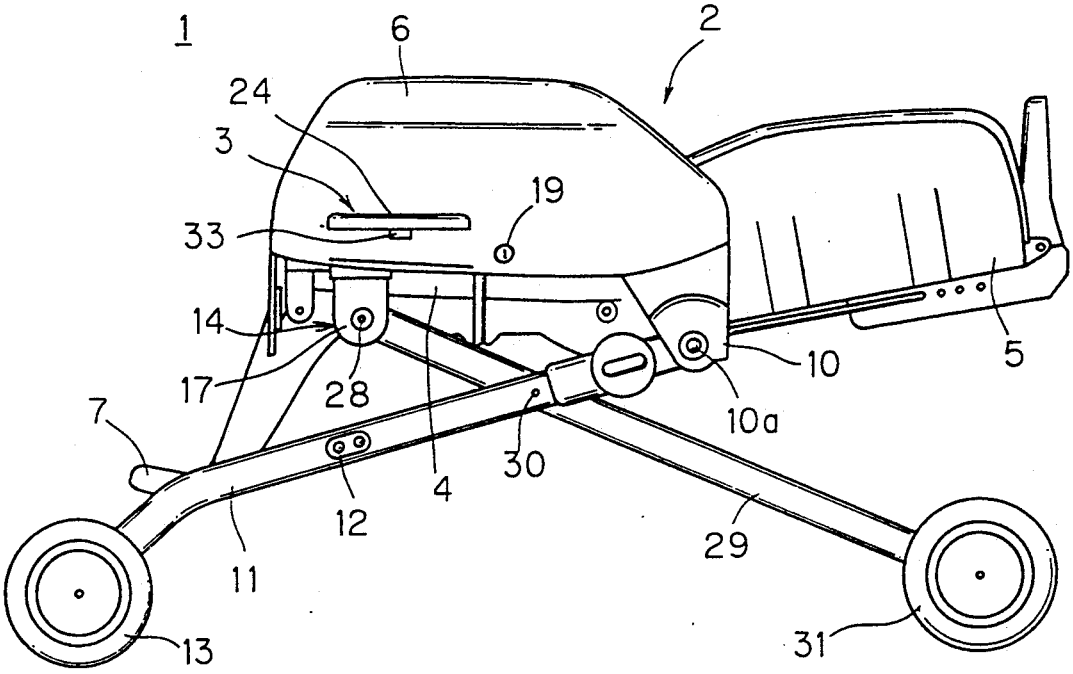
FIG. 2 is a side elevational view showing the childcare chair 1 of FIG. 1, whose seat portion 2 is brought into the lowermost position.
Figure 3:
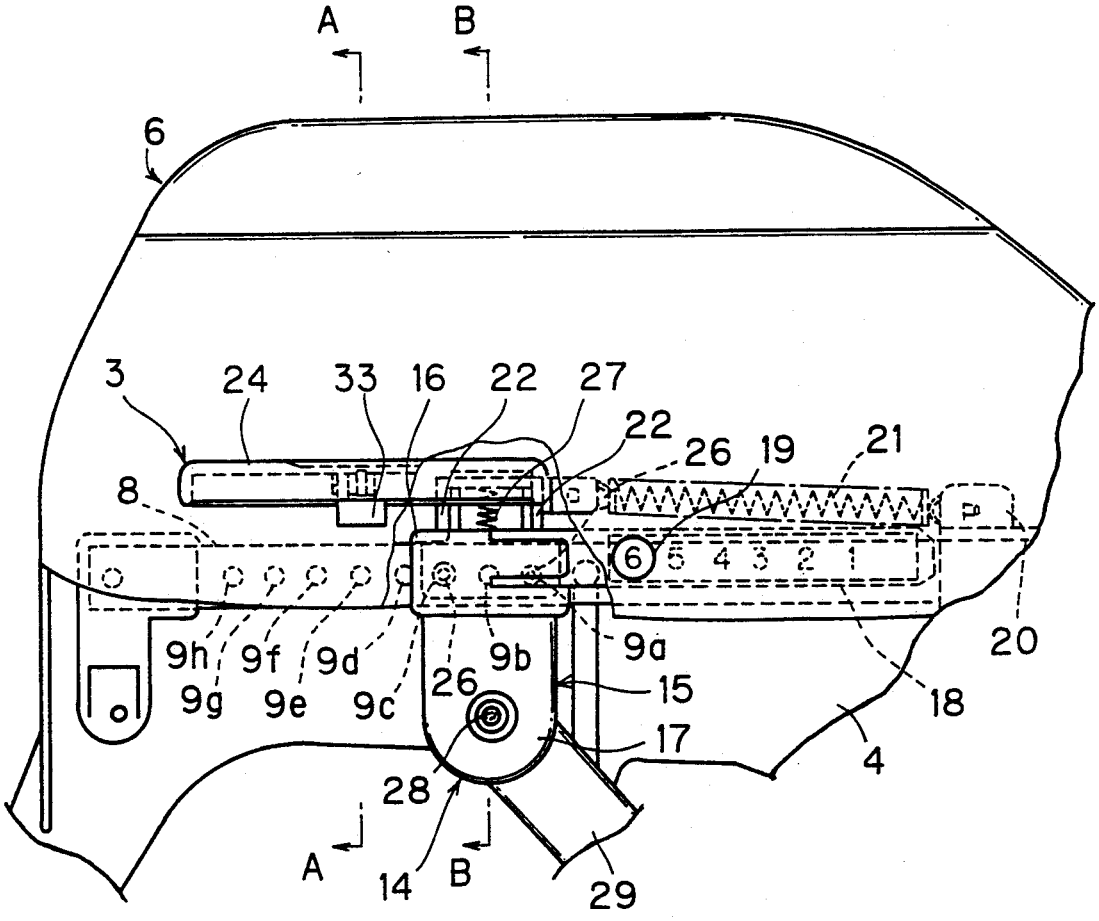
FIG. 3 is a partially fragmented enlarged side elevational view showing a principal part of the seat portion 2, which is provided in the childcare chair 1, in a state corresponding to FIG. 1.
Figure 4:
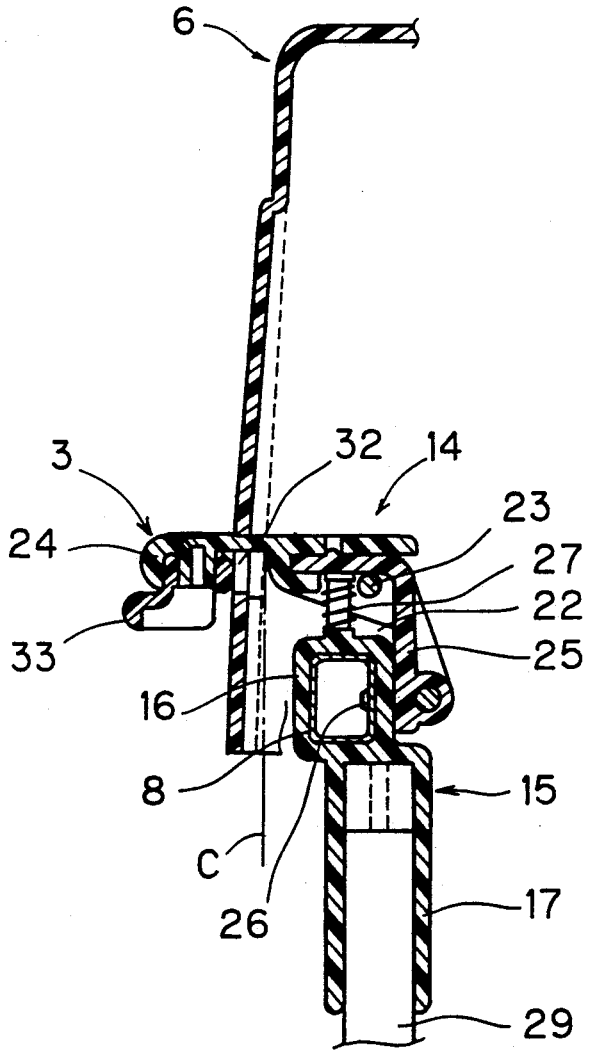
FIGS. 4 and 5 are sectional views showing sections taken along lines A—A and B—B in FIG. 3 on left and right sides of lines C respectively, for illustrating unlocked and locked states of a control lever 3 respectively.
Figure 5:
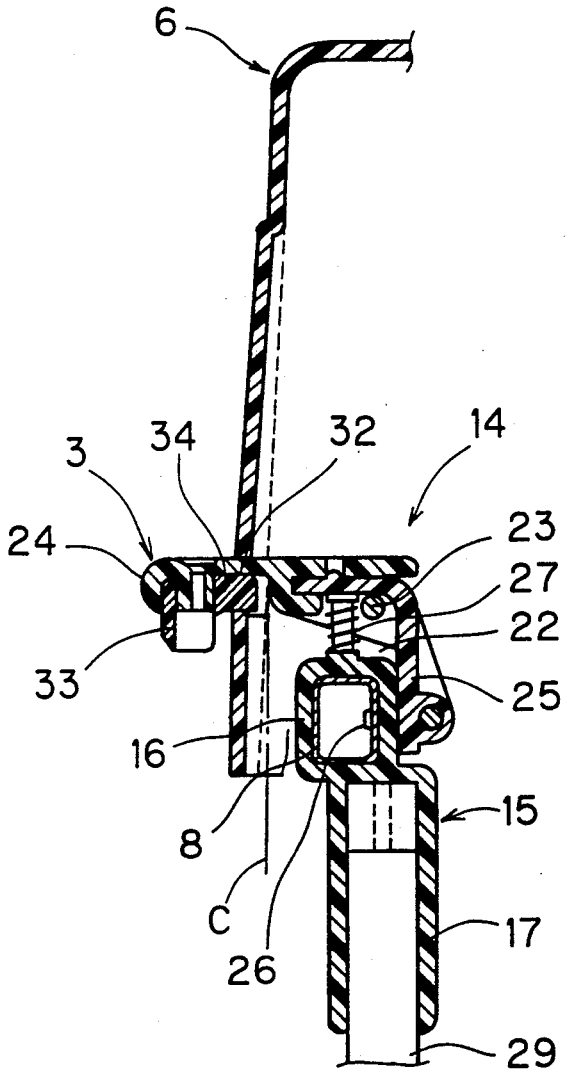

FIG. 1 shows the childcare chair 1 whose seat portion 2 is brought into the uppermost position, while the seat portion 2 is brought into the lowermost position in FIG. 2. FIG. 3 is a partially fragmented view showing a principal part of the seat portion 2, which is provided in the childcare chair 1, in the uppermost position as shown in FIG. 1. FIGS. 4 and 5 are sectional views showing sections taken along the lines A—A and B—B in FIG. 3 on left and right sides of lines C respectively. FIG. 4 shows an unlocked (rotatable) state of a control lever 3, and FIG. 5 shows a locked (unrotatable) state of the control lever 3.

As shown in FIGS. 1 and 2, the seat portion 2 comprises a seat 4 and a backrest 5. Comparing FIGS. 1 and 2 with each other, it is understood that the backrest 5 is reclinable with a changeable angle of inclination. Further, the backrest 5 can be inclined at an intermediate angle between the states shown in FIGS. 1 and 2.

Side walls 6 are located on both sides of the seat 4, and a footrest 7 is provided to downwardly extend from the front end of the seat 4.

The childcare chair 1 basically has a laterally symmetrical structure. Therefore, most of the elements shown in FIGS. 1 to 5 are provided in pairs on left and right sides of the childcare chair 1 respectively.

Each of the side walls 6 has an inverted U-shaped section as a whole, and a horizontally extending side bar 8 is fixed in its interior, as shown in FIGS. 3 to 5. Such a pair of side bars 8 are arranged in parallel with each other. Each side bar 8 is formed by a pipe having a rectangular section, for example, and provided with a plurality of, e.g., eight engaging holes **9*a* to 9*h***, which are distributed along its longitudinal direction.

As shown in FIGS. 1 and 2, a bracket 10 is provided on a rear end portion of each side wall 6, so that each of a pair of first leg members 11 is rotatably mounted on the bracket 10 through a pin **10*a*. A width setting bar 12 extends across the pair of first leg members 11, thereby reinforcing the first leg members 11. FIGS. 1 and 2 illustrate only a portion, which is mounted on one of the first leg members 11, of the width setting bar 12. Wheels 13 are rotatably mounted on a lower end portion of each first leg member 11**.

Referring to FIGS. 3 to 5, a slider 14 is mounted on each side bar 8, to be slidable along the side bar 8. This slider 14 comprises a slider body 15, as well as the aforementioned control lever 3.

The slider body 15 has a guide tube 16 enclosing the side bar 8 and a bracket 17 downwardly extending from the guide tube 16.

A horizontally elongated display board 18 rearwardly extends from the guide tube 16. A sheet indicating numerals such as "1" to "6", for example, is pasted onto the display board 18. One of the numerals "1" to "6" can be seen through a window 19, which is provided on the side wall 6. Each of these numerals is adapted to indicate the current vertical position of the childcare chair 1, and intervals between these numerals are selected to be equal to those between the aforementioned engaging holes **9*a* to 9*h***.

As shown in FIG. 3, a tension spring 21 is coupled between the slider body 15 and a stationary part 20 of the side wall 6. This tension spring 21 urges the slider body 15 to rearwardly slide along the side bar 8.

Other brackets 22 are provided to upwardly extend from the upper surface of the guide tube 16. These brackets 22 rotatably hold the control lever 3 about a pin 23.

The control lever 3 is formed by two parts, i.e., a control part 24 and an acting part 25, in consideration of manufacturing, and integrated afterwards. Engaging projections 26 are provided on one end of the control lever 3, to engage with selected ones of the engaging holes **9*a* to 9*h*. The guide tube 16 is provided with through holes for allowing passage of the engaging projections 26 therethrough, so that the engaging projections 26 can reach the side bar 8. Two such engaging projections 26 are arranged side by side to engage with the two engaging holes 9***a* and 9*c* in the state shown in FIG. 3. Thus, the engaging projections 26 engage with the engaging holes 9*a* to 9*h* in six modes, whereby the seat portion 2 of this childcare chair 1 is height-controllable in six stages.

The control lever 3 is urged by a compression spring 27 to be rotated in a direction for bringing the engaging projections 26 into engagement with the selected ones of the engaging holes 9*a* to 9*h*.

A pair of second leg members 29 are rotatably mounted on the brackets 17 of the slider bodies 15, which are provided in the sliders 14, through pins 28. Intermediate portions of the second leg members 29 are rotatably coupled to respective intermediate portions of the first leg members 11 through pins 30 respectively. Wheels 31 are rotatably mounted on lower end portions of the second leg members 29 respectively.

As clearly shown in FIGS. 4 and 5, each control lever 3 is arranged to pass through the side wall 6. The side wall 6 is provided with a through hole 32, which extends in a range for allowing such passage as well as rotation of the control lever 3. Thus, most of the control part 24 of the control lever 3 outwardly extends from the side wall 6. A locking member 33 is operably mounted on the control part 24, in order to inhibit rotation of the control lever 3 by filling up a clearance in relation to the control lever 3 within the through hole 32.

According to this embodiment, the locking member 33 is mounted on the lower surface of the control part 24 to be rotatable about a vertical axis. This locking member 33 is provided with a pawl 34 (FIG. 5), which engages in the through hole 32 as shown in FIG. 5 upon rotation of the locking member 33, to inhibit rotation of the control lever 3.

Thus, the locking member 33 is adapted to inhibit rotation of the control lever 3, whereby it is possible to prevent the control lever 3 from unexpected rotation even if the size of or the degree of projection of the control part 24 from the side wall 6 is increased in consideration of operability of the control lever 3. According to this embodiment, the control part 24 is horizontally elongated in the exterior of the side wall 6.

A method of controlling the height of the childcare chair 1 is now described.

First, it is supposed that the childcare chair 1 is used with the seat portion 2 being brought into the uppermost position, as shown in FIG. 1. In this state, the engaging projections 26 engage with the engaging holes 9*a* and 9*h*, as shown in FIG. 3. Further, the pawl 34 of the locking member 33 engages in the through hole 32 as shown in FIG. 5, thereby inhibiting the control lever 3 from rotation. As shown in FIG. 3, the window 19 which is provided in the side wall 6 displays the numeral "6" indicating the uppermost position of the seat portion 2.

In order to lower the vertical position of the seat portion 2 from the state shown in FIG. 1, the locking member 33 is first rotated so that the pawl 34 disengages from the through hole 32 as shown in FIG. 4. Then, the control part 24 of the control lever 3 is downwardly displaced so that the engaging projections 26 disengage from the engaging holes 9*a* and 9*c*. While this state is maintained, the seat portion 2 is downwardly displaced. In response to this, the slider 14 frontwardly slides along the side bar 8, to change the angle of intersection between the first and second leg members 29. When the seat portion 2 is brought into a desired vertical position, the force applied to the control lever 3 is removed so that the control lever 3 is rotated by the compression spring 27 and the engaging projections 26 engage with any ones of the engaging holes 9*a* to 9*h*.

Assuming that the seat portion 2 is brought into the lowermost position as shown in FIG. 2, for example, the engaging projections 26 engage with the engaging holes 9*f* and 9*h*. In this state, the window 19 displays the numeral "1", which indicates the lowermost position of the seat portion 2. In order to continuously use the childcare chair 1 in this state, the locking member 33 is so rotated that the pawl 34 engages with the through hole 32 as shown in FIG. 5.

An operation for bringing the seat portion 2 from a low position to a high position is substantially similar to the above. Such an operation for bringing the seat portion 2 from a low position to a high position can be made with smaller force due to the action of the tension spring 21.

In the aforementioned embodiment, the wheels 13 and 31 facilitate movement of the childcare chair 1 to an arbitrary position in a state holding a baby, as well as horizontal reciprocation of the childcare chair 1, whereby it is possible to naturally put the baby to sleep. Further, the wheels 13 and 31 also facilitate movement of the first and second leg members 11 and 29 with respect to the floor, whereby it is possible to easily control the vertical position of the seat portion 2.

Figure 6:
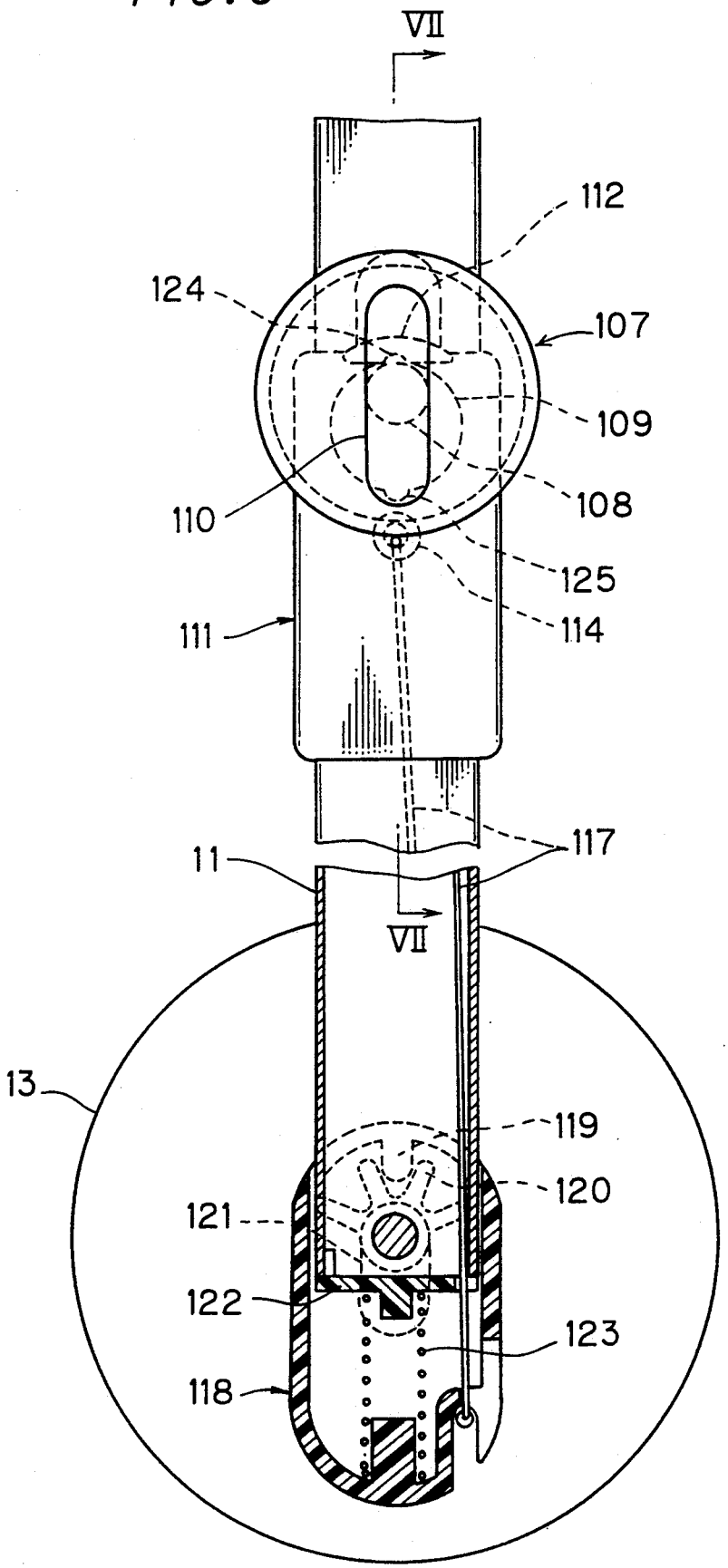
FIG. 6 is a partially fragmented enlarged side elevational view showing a first leg member 11 and a wheel 13, which are provided in the childcare chair 1, in a stopped state of the wheel 13.
Figure 7:
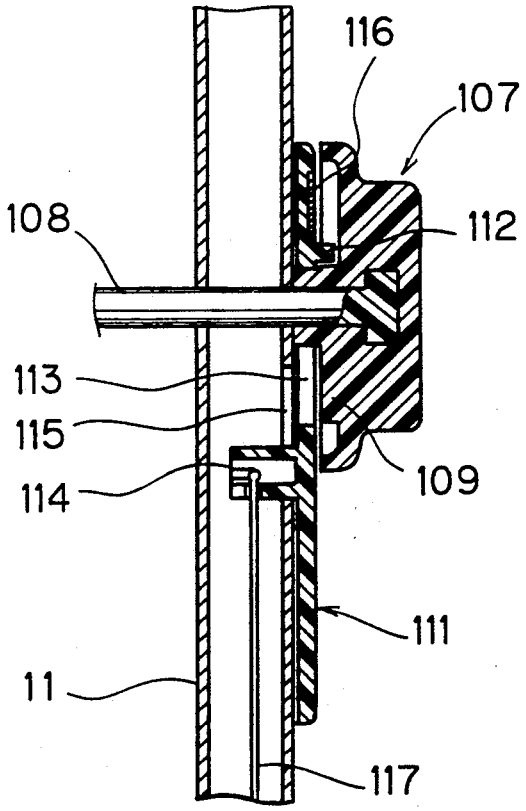
FIG. 7 is a sectional view taken along the line VII—VII in FIG. 6.
Figure 8:
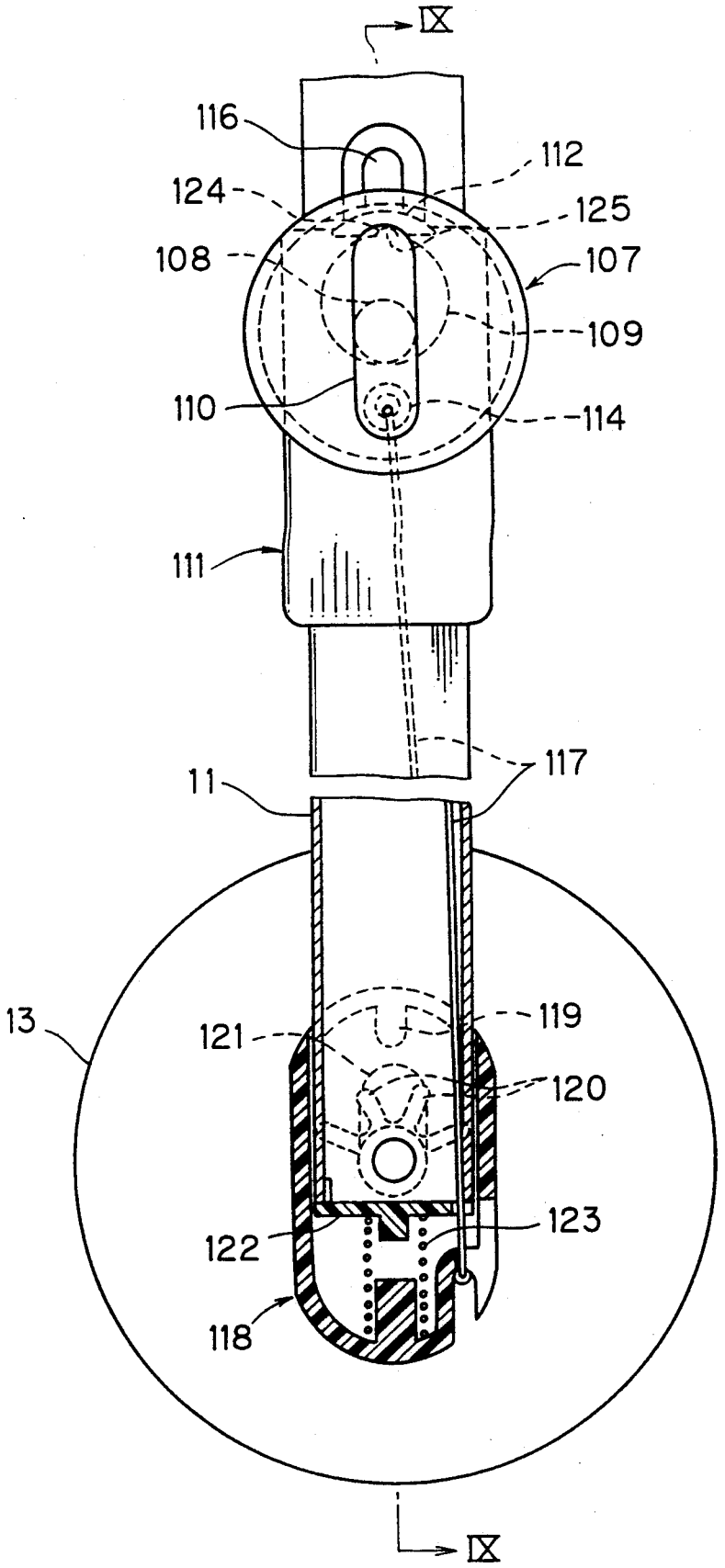
FIG. 8 is a side elevational view corresponding to FIG. 6, showing a rotatable state of the wheel 13.
Figure 9:
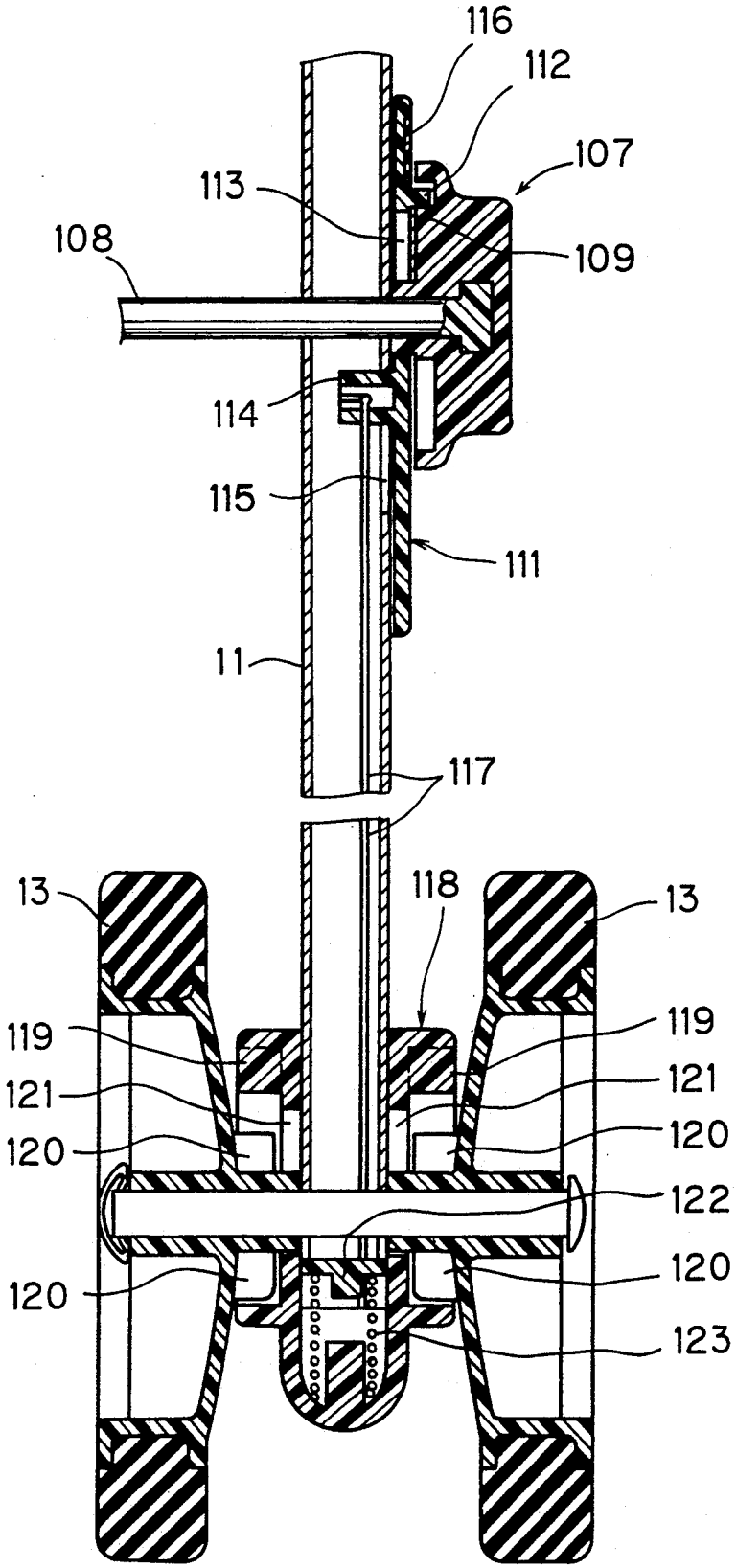
FIG. 9 is a sectional view taken along the line IX—IX in FIG. 8.

According to this embodiment, a wheel stopper is provided in relation to the pair of first leg members 11. FIGS. 6 to 9 illustrate a structure which is related to one of the leg members 11 in an enlarged manner. FIGS. 6 and 7 show a stopped state of the wheel 13, while FIGS. 8 and 9 show a rotatable state of the wheel 13.

The leg member 11 is formed by a hollow bar such as a pipe having a rectangular section, for example.

A control knob 107 is rotatably mounted on an outer side surface of the leg member 11. An interlocking bar 108 provides the axis of rotation of such a control knob 107. The interlocking bar 108 extends through the leg member 11, to be rotatable about the central axis of itself. The control knob 107 is fixed to an end portion of such an interlocking bar 108.

While FIGS. 7 and 9 illustrate only one end of the interlocking bar 108, another control knob 107 is fixed to the other end of the interlocking bar 108. Thus, such a pair of control knobs 107 are interlocked with each other by the interlocking bar 108 extending across the pair of leg members 11.

A cam 109 is formed in each control knob 107. Further, a projection 110 is provided on the control knob 107, in order to facilitate its rotating operation.

A first slider 111 is mounted between the leg member 11 and the control knob 107, to be longitudinally slidable along the leg member 11. The first slider 111, serving as a follower for the cam 109, comprises a follower part 112 which is in contact with the cam 109.

The first slider 111 is provided with a slot 113, which allows its sliding operation while receiving parts of the interlocking bar 108 and the control knob 107.

The first slider 111 is further provided with a wire mounting part 114, which extends into the hollow leg member 11. The leg member 11 is provided with a slot 115, which receives the wire mounting part 114, while allowing the sliding operation of the first slider 111.

An appropriately colored sheet 116 is pasted onto an upper end portion of the first slider 111. Comparing FIGS. 6 and 8 with each other, it is understood that the sheet 116 can be exposed from or hidden by the control knob 107, in response to the sliding movement of the first slider 111.

A wire 117 is arranged in the hollow leg member 11. An end of the wire 117 is coupled to the wire mounting part 114 of the first slider 111, while the other end thereof is coupled with a second slider 118.

The second slider 118 is mounted on the lower end portion of the leg member 11 to be longitudinally slidable along the leg member 11.

The second slider 118 is provided with engaging portions 119, which engage with parts of the wheels 13 upon downward movement for holding the wheels 13 in the stopped state as shown in FIG. 6. According to this embodiment, each engaging portion 119 is adapted to engage with one of a plurality of ribs 120, which radially extend from the center of each wheel 13.

The second slider 118 is further provided with slot 121, which allow vertical sliding thereof while receiving parts of the wheels 13.

The lower end portion of the leg member 11 is closed by a spring shoe member 122. A compression spring 123 is arranged between the spring shoe member 122 and the bottom portion of the second slider 118. The compression spring 123 urges the second slider 118 to downwardly slide.

A method of using the aforementioned wheel stopper is now described.

In the state shown in FIGS. 6 and 7, each engaging portion 119 of the second slider 118 engages with one of the ribs 120, to maintain the wheel 13 in the stopped state. This state results from downward sliding of the second slider 118 caused by the action of the compression spring 123. In order to enable this state, the first slider 111 is also in a downwardly sliding state.

When the control knob 107 is rotated by 180° from the aforementioned state, the state shown in FIGS. 8 and 9 is attained. Namely, the first slider 111 is urged to upwardly slide by the action of the cam 109 through the follower part 112, which is in contact with the cam 109. In order to further stably maintain this state, the follower part 112 may be provided with a small cavity part 124, while the cam 109 may be provided with a projecting part 125 which engages with the cavity part 123.

When the first slider 111 upwardly slides as hereinabove described, this operation is transmitted to the second slider 118 through the wire 117. Therefore, the second slider 118 also upwardly slides against resilience of the compression spring 123, whereby the engaging portions 119 disengage from the ribs 120. Thus, the wheel 13 is brought into a.rotatable state.

Such a rotatable state of the wheels 13 can be confirmed through the sheet 116, which is exposed from the control knob 107. Thus, it is possible to recognize the rotatable state of the wheels 13 through the sheet 116. The sheet 116 may display appropriate characters etc. in place of or in addition to the aforementioned coloring.

Thus, according to this embodiment, it is possible to switch the wheels 13 provided in the childcare chair 1 between stopped and rotatable states by a simple operation of rotating the control knobs 107.

Therefore, it is possible to directly effectuate the advantages originally provided in the childcare chair 1 by bringing the wheels 13 into rotatable states. Namely, it is easy to move the childcare chair 1 to an arbitrary position while carrying the baby in this chair 1. Further, it is possible to naturally put the baby into sleep by horizontally reciprocating the childcare chair 1.

When the wheels 13 are brought into stopped states, on the other hand, it is possible to prevent the childcare chair 1 from unexpected movement. Therefore, the baby carer can leave the childcare chair 1 with no anxiety while laying the baby therein.

Since the spring 123 provided in relation to the second slider 118 regularly urges each engaging portion 119 to engage with one of the ribs 120, which are parts of each wheel 13, it is possible to reliably maintain the stopped state of the wheels 13. Even if a failure such as damage of the wire 117 takes place, each wheel 13 is hardly brought into a rotatable state since the spring 123 is adapted to maintain the stopped state of each wheel 13. Thus, it is possible to improve safety of the childcare chair 1 according to this embodiment.

The inventive childcare chair 1 is provided with the aforementioned pair of hollow leg members 11, each having the control knob 107, the first slider 111, the wire 117, the second slider 118 and the spring 123, whereby the pair of two wheels 13 can be simultaneously brought into stopped states, to further reliably maintain the childcare chair 1 in the stopped state. When the pair of control knobs 107 are interlocked with each other by the interlocking bar 108 extending across the pair of leg members 11, it is possible to simultaneously rotate the pair of control knobs 107 by manipulating only one control knob 107. Thus, it is possible to simplify the operation for bringing the wheels 13 into a stopped or rotatable state.

Figure 10:
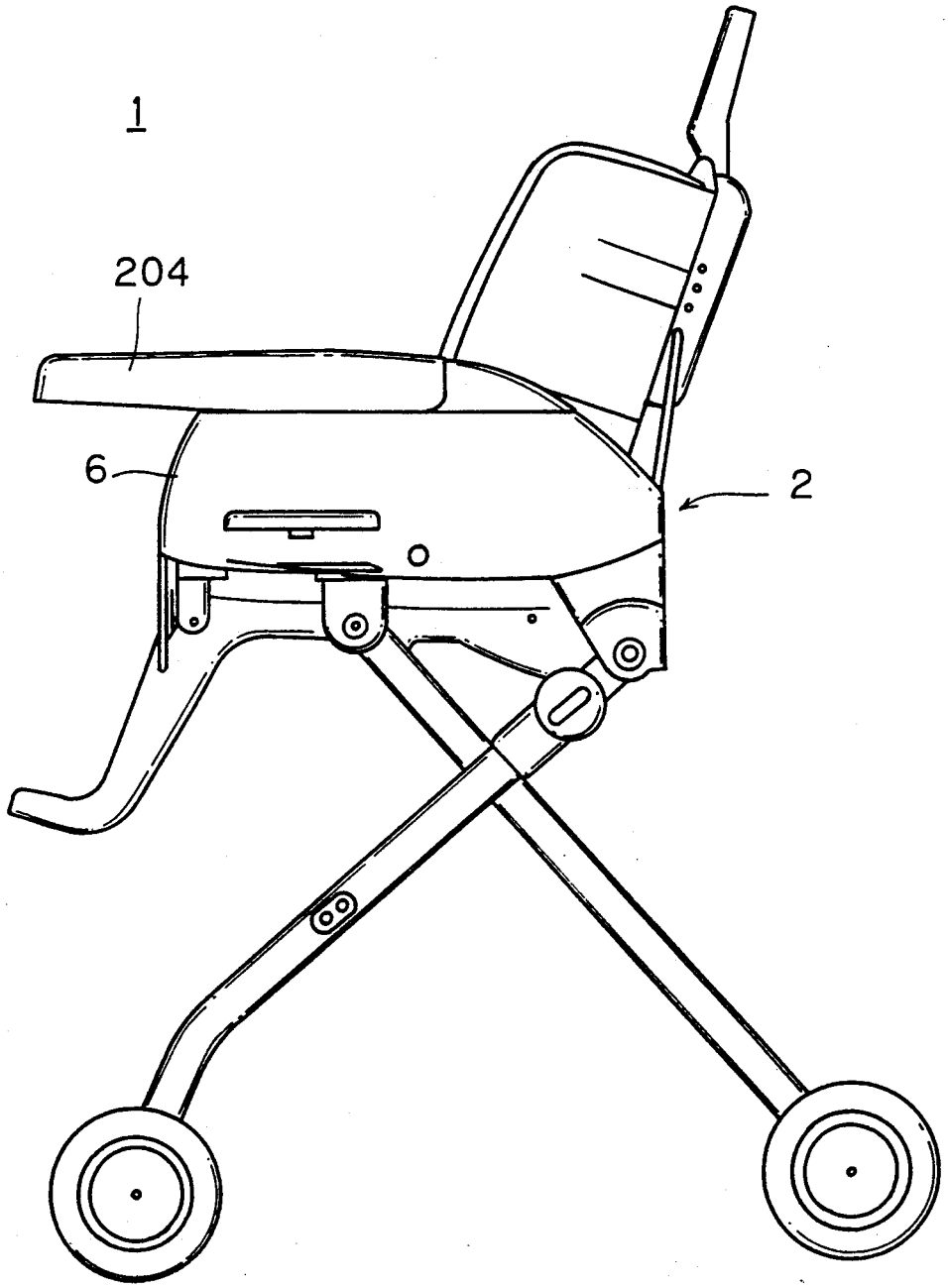
FIG. 10 is a side elevational view showing a childcare chair 1, on which a table 204 is mounted.

As shown in FIG. 10, a table 204 can be mounted on the aforementioned childcare chair 1. The table 204 is mounted to extend across the pair of side walls 6.

Figure 11:
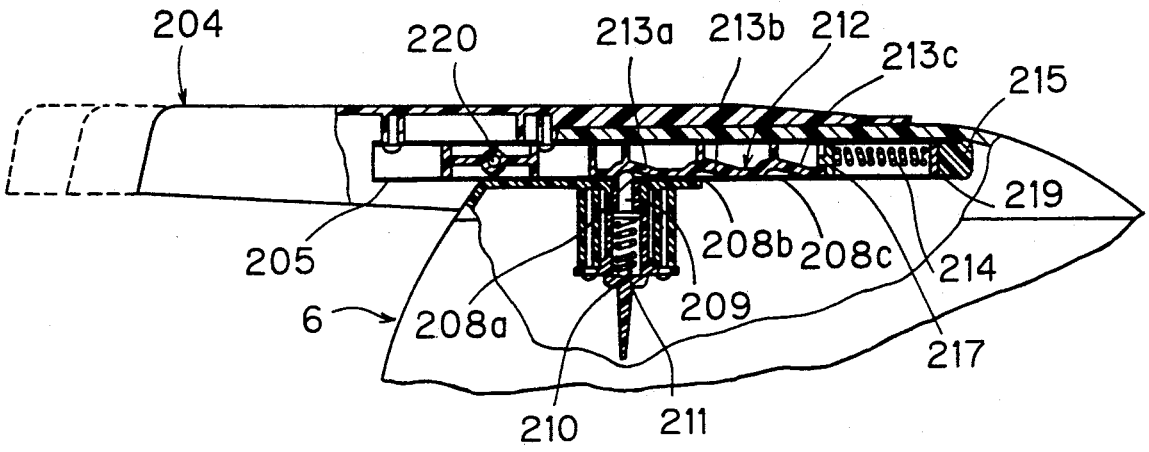
FIG. 11 is a partially fragmented side elevational view showing the table 204 which is mounted on a side wall 6 of the childcare chair 1 shown in FIG. 10.
Figure 12:
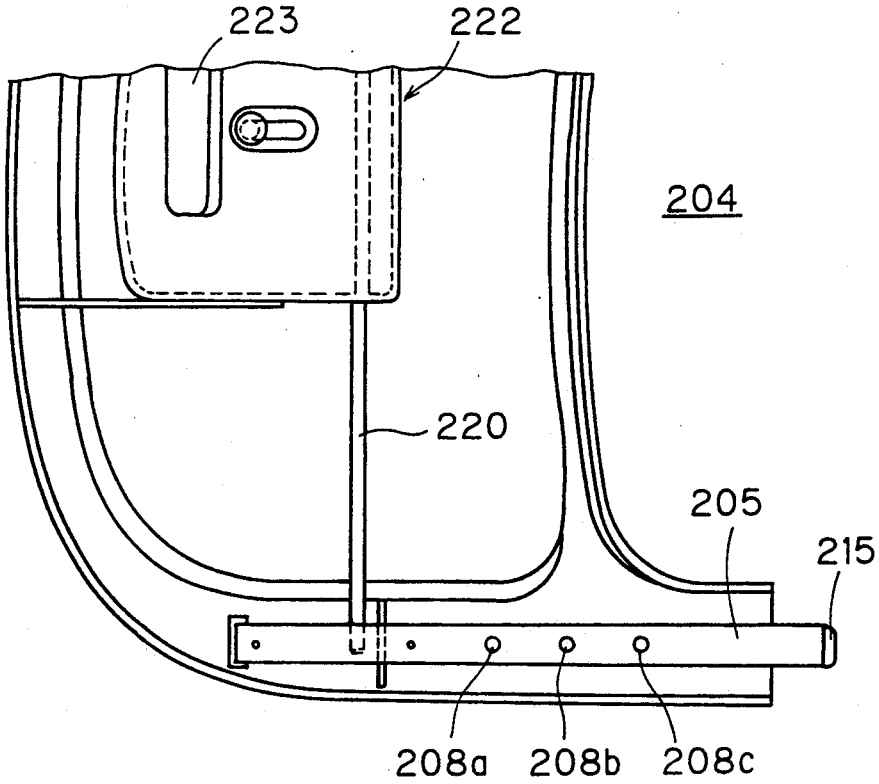
FIG. 12 is a bottom plan view independently showing the table 204 which is detached from the childcare chair 1.
Figure 13:
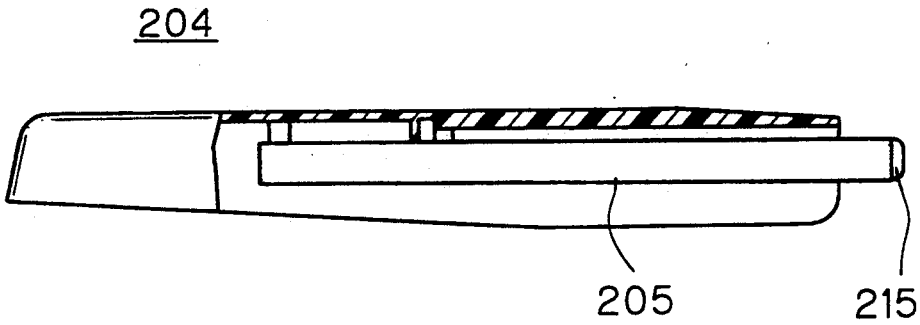
FIG. 13 is a partially fragmented side elevational view also independently showing the table 204.
Figure 14:
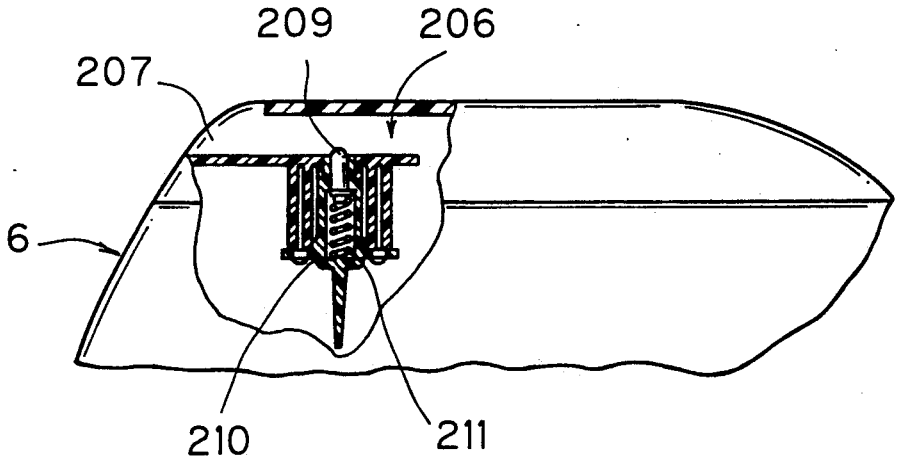
FIG. 14 is a partially fragmented side elevational view showing the side wall 6 from which the table 204 is detached.

FIG. 11 shows the table 204, which is mounted on the side walls 6, in further detail. While FIG. 11 shows the structure of the table 204 in relation to only one of the side walls 6, a substantially similar structure is provided in relation to the other side wall 6. FIG. 12 is a bottom plan view independently showing the table 204. FIG. 13 is a partially fragmented side elevational view also independently showing the table 204. FIG. 14 is a partially fragmented side elevational view showing the side wall 6, from which the table 204 is detached.

As clearly shown in FIGS. 12 and 13, a horizontally extending hollow side bar 205 is fixed to the table 204. A pair of such side bars 205 are arranged in parallel with each other along left and right side portions of the table 204. Each side bar 205 is formed by a pipe having a rectangular section, for example.

As clearly shown in FIG. 14, on the other hand, a space 206 is provided in each side wall 6, in order to longitudinally slidably receive each side bar 205. The space 206 has an opening 207 in its front end.

A plurality of, e.g., three engaging holes 208*a*, 208*b* and 208*c* are longitudinally distributed along each side bar 205.

On the other hand, an engaging pin 209 is mounted on each side wall 6. The engaging pin 209 is held by a case 210 which is fixed to the side wall 6, to be brought into projecting and non-projecting states with respect to the space 206. The forward end of the engaging pin 209 is rounded. A compression spring 211 is arranged between the engaging pin 209 and the bottom surface of the case 210. Thus, the engaging pin 209 is urged by the compression spring 211 toward a direction for projecting into the space 206. Due to such action of the compression spring 211, the engaging pin 209 engages with a selected one of the engaging holes 208 to 208*c*. In the state shown in FIG. 11, for example, the engaging pin 209 engages with the engaging hole 208*a*.

Figure 15:
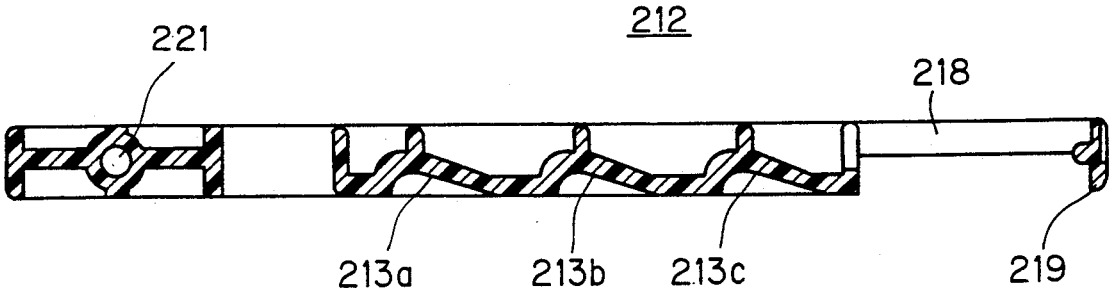
FIG. 15 is a longitudinal sectional view independently showing a translation cam member 212.

As shown in FIG. 11, each side bar 205 is provided therein with a longitudinally slidable translation cam member 212. FIG. 15 independently shows the translation cam member 212, which is provided with cam surfaces 213*a*, 213*b* and 213*c* in positions corresponding to the engaging holes 208 to 208*c* respectively. Upon unidirectional sliding movement (leftward movement in FIG. 15) of the translation cam member 212, the cam surfaces 213*a* to 213*c* come into contact with the forward end of the engaging pin 209 engaging with a corresponding one of the engaging holes 208*a* to 208*c*, to forcibly bring the same into a non-projecting state.

Figure 16:
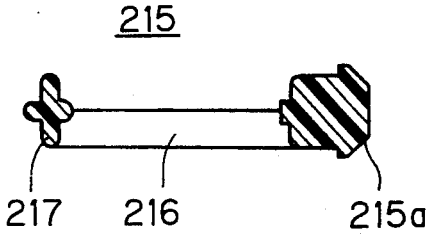
FIG. 16 is a longitudinal sectional view independently showing a pipe end 215.

The aforementioned translation cam member 212 is urged by a compression spring 214 to rightwardly slide in FIG. 11. While it is possible to alternatively use a tension spring, the compression spring 214 is employed in this embodiment in consideration of durability and stability of its spring action. FIG. 16 independently shows a pipe end 215, which is employed for applying rightward spring force to the translation cam member 212 by the compression spring 214.

The pipe end 215 is fixed to a right end portion of the hollow side bar 205. This pipe end 215 is provided with a spring shoe part 217 in a position separated through a coupling part 216. On the other hand, the translation cam member 212 is provided on its right end with another spring shoe part 219, in a position separated by another coupling part 218. When the translation cam member 212 and the pipe end 215 are mounted on the side bar 205, the spring shoe part 219 of the translation cam member 212 is located on the right side of the spring shoe part 217 of the pipe end 215, as shown in FIG. 11. When the compression spring 214 is arranged between the spring shoe parts 217 and 219, therefore, the translation cam member 212 is urged by the compression spring 214 to rightwardly slide.

A pair of such translation cam members 212 are coupled with each other by an interlocking bar 220, which is clearly shown in FIG. 12. This interlocking bar 220 extends through one wall of each hollow side bar 205, to be inserted in a hole 221 (FIG. 15) which is formed in each translation cam member 212. In order to allow the aforementioned sliding movement of the translation cam member 212, therefore, a portion of the side bar 205 receiving the interlocking bar 220 is provided in the form of a slot longitudinally extending along the side bar 205, for example.

As shown in FIG. 12, the table 204 is provided with operating member 222 for causing leftward sliding movement of the pair of translation cam members 212 through the interlocking bar 220. This operating member 222 is so mounted as to slide along the lower surface of the table 204. The operating member 222 is provided with a cavity 223 for receiving fingers of the user, to facilitate manipulation of the operating member 222.

A method of using the childcare chair 1 is now described, particularly in relation to the table 204.

In this childcare chair 1, the table 204 can be detached from the side walls 6, as shown in FIGS. 13 and 14.

First, an end of each side bar 205 is inserted in the space 206 from the opening 207 of each side wall 6, in order to mount the table 204 on the childcare chair 1. In such a relatively initial stage of insertion, the end of the side bar 205, more correctly an end portion of the pipe end 215, comes into contact with the engaging pin 209, which is in a projecting state. However, when the side bar 205 is further strongly pushed into the space 206, the engaging pin 209 is guided by its rounded forward end and a tapered surface 215*a* (FIG. 16) formed on the end portion of the pipe end 215 to be brought into a non-projecting state.

The side bar 205 is inserted in the space 206 in the aforementioned manner, until the table 204 is brought into a desired position. At this time, the operating member 222 is preferably manipulated to allow leftward sliding of the translation cam member 212. Upon such leftward sliding of the translation cam member 212, the cam surfaces 213*a* to 213*c* force the engaging pin 209, which is going to engage with the engaging holes 208*a* to 208*c*, into a non-projecting state. Thus, it is possible to align the engaging pin 209 with an arbitrary one of the engaging holes 208*a* to 208*c*.

When the table 204 is brought into a desired position or in the vicinity thereof, the operating member 222 is relieved. Thus, the translation cam member 212 rightwardly slide due to the action of the compression spring 214, so that the cam surfaces 213*a* to 213*c* enter states allowing deep insertion of the engaging pin 209 in the engaging holes 208*a* to 208*c*. When the table 204 is slightly horizontally moved at need, therefore, the engaging pin 209 automatically engages with a selected one of the engaging holes 208*a* to 208*c*.

Referring to FIG. 11, the engaging pin 209 engages with the engaging hole 208*a*. In this state, the table 204 is strongly fixed to the side wall 6.

In order to change the position of the table 204 from the state shown in FIG. 11, the operating member 222 is again manipulated so that the translation cam member 212 leftwardly slides through the interlocking bar 220. Therefore, the cam surface 213*a* comes into contact with the forward end of the engaging pin 209, engaging with the engaging hole 208*a*, to force the same into a non-projecting state. In this state, the table 204 is leftwardly drawn out, for example, whereby the engaging pin 209 is guided by its rounded forward end to disengage from the engaging hole 208*a*, so that the same is engageable with the adjacent engaging hole 208*b*, or the engaging hole 208*c* next thereto. Then the operating member 222 is relieved so that the engaging pin 209 completely engages with the engaging hole 208*b* or 208*c*, to reliably fix the table 204.

Thus, according to this embodiment, it is possible to obtain the childcare chair 1, which is provided with the horizontally adjustable table 204.

In such a childcare chair 1, it is possible to reliably fix the table 204 in an adjusted position through the engaging pin 209, which is urged by the spring 211 in a projecting direction to engage with any one of the engaging holes 208*a* to 208*c*. Therefore, the table 204 is prevented from unexpected displacement, to be improved in safety for the baby.

The operation for adjusting the position of the table 204 is extremely simple. Namely, the operating member 222 may be simply manipulated to horizontally move the table 204, and then relieved at a desired point of time. The operating member 222 can be manipulated in a one-handed manner.

Although the present invention has been described and illustrated in detail, it is clearly understood that the same is by way of illustration and example only and is not to be taken by way of limitation, the scope of the present invention being limited only by the terms of the appended claims.

WHAT IS CLAIMED IS:

1. A chair comprising:

a seat portion (2);

a pair of side walls (6) located on both sides of said seat portion (2);

a pair of side bars (8), horizontally extending in parallel to each other, fixed to said side walls (6) respectively;

a pair of first leg members (11) rotatably mounted on said side walls (6) respectively;

a pair of sliders (14) mounted on said side bars (8) to be slidable along said side bars (8) respectively; and a pair of second leg members (29) rotatably mounted on said sliders (14) respectively, said second leg members (29) having intermediate portions being rotatably coupled to respective intermediate portions of said first leg members (11), wherein a plurality of engaging holes (9*a*–9*h*) are longitudinally distributed along each said side bar (8), and each said slider (14) comprises a control lever (3) having an engaging projection (26) for engaging with a selected one of said plurality of engaging holes (9*a*–9*h*) on its one end and a spring (27) for rotating said control lever (3) in a direction for allowing engagement of said engaging projection (26) with said selected one of said engaging holes (9*a*–9*h*).

2. A chair in accordance with claim 1, wherein each said control lever (3) passes through each said side wall (6), and each said side wall (6) is provided with a through hole (32) extending in a range for allowing such passage as well as rotation of said control lever (3), said chair further comprising a locking member (33) for selectively inhibiting rotation of said control lever (3) by filling up a clearance in relation to said control lever (3) within said through hole (32).

3. A chair in accordance with claim 1, wherein at least one of said sliders (14) comprises a display surface (18) for displaying the vertical position of said seat portion (2), and a window (19) is provided in a related said side wall (6) for exposing said display surface (18).

4. A chair in accordance with claim 1, further comprising a tension spring (21) coupled between at least one of said sliders (14) and a related said side wall (6), thereby urging said slider (14) to slide along said side bar (8) in a direction for approaching respective end portions of said first and second leg members (11, 29) to each other.

5. A chair in accordance with claim 1, further comprising rotatable wheels (13, 31) mounted on respective lower end portions of said first and second leg members (11, 29).

6. A chair in accordance with claim 5, wherein at least one (11) of said leg members is formed by a hollow bar, a control knob (107) provided with a cam (109) is rotatably mounted on the outer side surface of said hollow leg member (11), a first slider (111) serving as a follower for said cam (109) is longitudinally slidably mounted on said hollow member (11), a wire (117) is arranged within said hollow leg member (11), an end of said wire (117) is coupled to said first slider (111) while a second slider (118) is coupled with the other end of said wire (117), said second slider (118) is mounted on a lower end portion of said hollow leg member (11) to be longitudinally slidable along said leg member (11), said second slider (118) is provided with an engaging portion (119) which engages with a part of said wheel (13) in response to downward sliding thereof for maintaining said wheel (13) in a stopped state, and said second slider (118) is urged by a spring (123) in a downwardly sliding direction.

7. A chair in accordance with claim 6, including a left and right pair of said hollow leg members (11), each comprising said control knob (107), said first slider (111), said wire (117), said second slider (118) and said spring (123), so that a pair of said control knobs (107) are interlocked with each other by an interlocking bar (108) extending across said pair of hollow leg members (11).

8. A chair in accordance with claim 6, wherein an operating range of said first slider (111) is so selected that its upper end portion is exposed from or hidden by said control knob (107) in response to sliding of said first slider (111).

9. A chair in accordance with claim 8, wherein a display (116) capable of calling attention is provided on said upper end portion of said first slider (111).

10. A chair in accordance with claim 6, wherein said cam (109) and said first slider (111) are provided with configurations (124, 125) for engaging with each other in an upwardly sliding state of said first slider (111).

11. A chair in accordance with claim 1, further comprising a table (204) mounted in a state extending across said pair of side walls (6).

12. A chair in accordance with claim 11, wherein a pair of horizontally extending hollow side bars (205), being parallel to each other, are fixed to said table (204), a space (206) is formed in each said side wall (6) for longitudinally slidably receiving each said side bar (205), a plurality of engaging holes (208*a*–208*c*) are longitudinally distributed along each said side bar (205), an engaging pin (209) having a rounded forward end is provided to be capable of entering projecting and non-projecting states with respect to said space (206) of each said side wall (6), said engaging pin (209) being urged by a spring (211) to be moved in a projecting direction for engaging with a selected one of said engaging holes (208*a*–208*c*) upon movement in said projecting direction by the action of said spring (211), a translation cam member (212) is longitudinally slidably provided in each said side bar (205), said translation cam member (212) being provided with cam surfaces (213*a*–213*c*) for coming into contact with said forward end of said engaging pin (209), engaging with said selected one of said engaging holes (208*a*–208*c*), for forcing the same into a non-projecting state by sliding movement in one direction, a pair of said translation cam members (212) are urged by a spring (214) to slide in another direction which is reverse to said one direction, said pair of translation cam members (212) are coupled with each other by an interlocking member (220), and said table (204) is provided with an operating member (222) for allowing sliding movement of said pair of translation cam members (212) in said one direction through said interlocking bar (220).

* * * * *